US006323785B1

(12) United States Patent
Nickell et al.

(10) Patent No.: US 6,323,785 B1
(45) Date of Patent: Nov. 27, 2001

(54) AUTOMATIC RAILROAD ALARM SYSTEM

(76) Inventors: Larry Nickell, HC 34 Box 325, Lewisburg, WV (US) 24901; John L. McCormack, Anderson St., Fairlea, WV (US) 24902; Marlin Van Wilson, Route 1 Box 449, Barboursville, VA (US) 22923

( * ) Notice: Subject to any disclaimer, the term of this patent is extended or adjusted under 35 U.S.C. 154(b) by 0 days.

(21) Appl. No.: 09/315,270

(22) Filed: May 20, 1999

Related U.S. Application Data

(60) Provisional application No. 60/086,176, filed on May 20, 1998.

(51) Int. Cl.[7] ..... G08G 1/01

(52) U.S. Cl. ..... 340/933; 340/905; 340/539; 246/292

(58) Field of Search ..... 340/933, 907, 340/905, 910, 903, 902, 908, 906, 988, 909, 539; 246/292, 293, 294, 295

(56) References Cited

U.S. PATENT DOCUMENTS 2,580,155 * 12/1951 Brannen ..... 340/903
3,758,775 * 9/1973 Hopkins ..... 340/903
4,038,653 * 7/1977 Brewster ..... 343/68 R
4,578,665 * 3/1986 Yang ..... 340/566
5,554,982 * 9/1996 Shirkey et al. ..... 340/903
5,620,155 * 4/1997 Michalek ..... 340/902
5,729,213 * 3/1998 Ferrai ..... 340/901
5,729,214 * 3/1998 Moore ..... 340/910
5,739,768 * 4/1998 Lane ..... 340/933
5,757,288 * 5/1998 Dixon ..... 340/941
5,864,304 * 1/1999 Gerszberg et al. ..... 340/903
5,877,706 * 3/1999 Summergill ..... 340/933
5,890,682 * 4/1999 Welk ..... 340/903
6,020,815 * 2/2000 Eslambolchi ..... 340/539

* cited by examiner

*Primary Examiner*—Daniel J. Wu
*Assistant Examiner*—Anh La
(74) *Attorney, Agent, or Firm*—Sheldon H. Parker

(57) ABSTRACT

A warning system provides for notification of the approach of a track guided train to a user work area perimeter. The system includes at least one sensor, preferably a plurality of sensors, for sensing the approach of a train. Data is collected and analyzed, with the analysis including the status of preprogrammed system criteria. Signals are transmitted to a remote receiving member. The remote receiving member can be part of an annunciator. An analysis member receiving and analyzes the signals and determines whether it is necessary to transmit a warning signal. At least one indicator provides a warning notification to a user. The data collection device at least periodically transmits signals to the programmable data analysis member and the analysis member determines the absence or proximity of a train.

18 Claims, 9 Drawing Sheets

AUTOMATIC RAILROAD ALARM SYSTEM

This is a continuation-in-part of copending provisional application Ser. No. 60/086,176 filed on May 20, 1998.

BACKGROUND OF THE INVENTION

1. Field of the Invention

The invention relates to an alarm system for use in warning of the imminent approach of a train, and more particularly, to a warning device for cautioning workers of an approaching train, by visual and audio signals.

2. Brief Description of the Prior Art

The typical operation of the Automatic Railroad System includes up to six parallel tracks running around curves, through cuts, fills, bridges, and tunnels maintaining a generally bi-directional train traffic flow. Additionally, there are multiple crossover connections between these tracks so that a train is likely to be on different tracks at different times and locations. Train traffic moves in both directions and at widely varying speeds along these sets of tracks with schedules and timing set and maintained by the control center maintaining the specific area of track. These schedules and timing, however, may be unknown to railroad work crews.

When high-speed trains are involved, approaching traffic must be sensed at distances of approximately one mile in either direction from the work site. At speeds of about 100 miles per hour, the train will close the one mile gap in slightly over half a minute, leaving little warning time. A worker must not only be clear of the train, but must also be out of the range of the suction created by the fast moving train.

Over the years, the warning systems have evolved to keep pace with the increasing speeds of the trains. The traffic warning systems must be portable to be useful wherever the work crew may be positioned as well as operate around whatever type of equipment is present in the work site. The current, prior art approach used with warning systems, has been the hard wiring of the sensor to the alarm, over the one mile distance. It is, however, not unusual for the wire to become broken or frayed at some point over its one mile length, thereby eliminating the effectiveness of the system and endangering the work crew.

The disclosed system provides a wireless system with multiple safety back ups built in. Further, the system provides a reliable system at a cost that does not render the system unfeasible.

BRIEF DESCRIPTION OF THE DRAWINGS

The advantages of the instant disclosure will become more apparent when read with the specification and the drawings, wherein.

SUMMARY OF THE INVENTION

Figure 1:
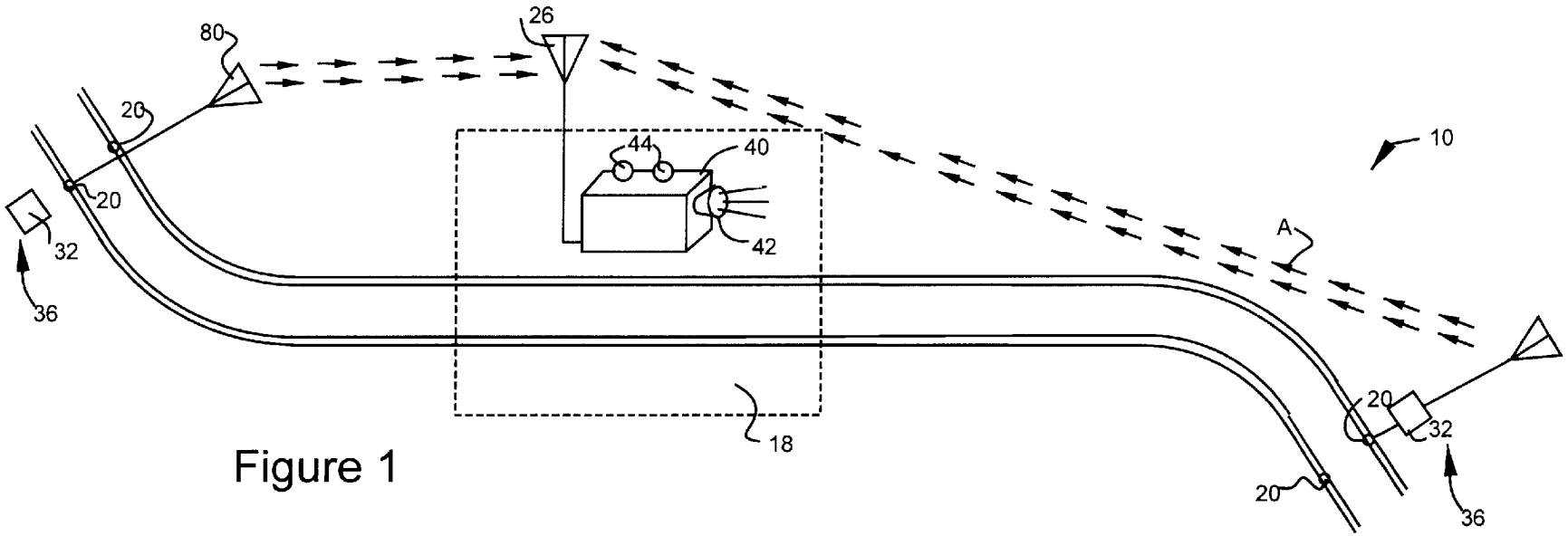
FIG. 1 is a schematic representation of a system in accordance with the present invention.

The disclosed system provides a substantial addition to existing traffic warning systems for crews working on train, as well as other transport, tracks. The disclosed system is designed to be a fail-safe to the maximum extent possible while offering the usual feature of technical systems of immunity from distractions and human type fatigue. As part of a total system, the system serves as a back up, or reinforcement, to the safety features of the presently used human-chain lookout system along with their visual and audible warnings. Although, for ease of description, the disclosure will refer to trains, it should be noted that the disclosed warning device is applicable to any track guided vehicle. It will be obvious to those skilled in the art any modifications required to adapt the system to subways, monorails or other track based systems.

The system is portable, consisting of three principal units, each capable of being hand carried to the setup location on the railroad. The units are designed to require minimal upkeep, mainly recharging the batteries at the maintenance base between work sessions. The units are designed to provide maximum performance, whether the approaching trains are high speed, low speed traffic intermingled on various tracks, or a combination of high and low speed inbound and outbound traffic. The system is capable of monitoring multiple tracks without compromising safety. The system consists of an annunciator placed within the work site, a pair of slave sensors per track, and a master sensor to receive and transmit data received from the slave sensors.

The value of the system is substantial, especially when the comparative cost of the system and the safety benefits are measured. The disclosed system provides a protection zone of one mile from the annunciator in either direction, with a reaction time of less than one second after the train is detected by the sensor. The warning system, such as a horn and strobe light, is preferably activated within 1.5 seconds from the time the train passes over the sensor. Although the time between the train passing over the sensors and activation of the warning system cannot be too long, the activation time can vary somewhat The ability of the system to detect speed enables the system to be programmed to activate the warning system depending upon train speed. One annunciator has the capability to monitor multiple sensors, thereby providing worker protection in multiple track situations without the need for duplicate systems.

The system preferably includes, in addition to the sensors for detecting the presence of a train and the direction of travel, a seismic, or vibration, sensor to serve as verification of a train's approach. In the preferred system, a sensor is placed on each track approximately one mile in each direction from the work site.

DETAILED DESCRIPTION OF THE INVENTION

The disclosed system is made up of three principal units that are powered by several self-contained rechargeable batteries. The annunciator and affiliated warning systems, is placed within the work site. A pair of slave sensors is placed on each track, in each directions, approximately one mile from the annunciator. The slave sensors, for each direction, are hardwired into a master sensor for data transmission to the annunciator. For safety reasons, the batteries preferably have an operating endurance of greater than ten (10) hours without recharge. All units are contained within rugged weatherproof cases, such as stainless steel, and are designed to function in the presence of dust, mud, vibration, heat, and cold.

In the following description, the sensing locations, preferably two per track, are referred to as "gates." Each gate consists of multiple slave sensors and a master sensor. Information as to whether a train is present and moving is the fundamental parameter in the operation of the disclosed system. To accomplish this, each gate must have the ability to sense the track for the presence of a train, the movement of the train, and the direction of the train's movement.

As seen in FIG. 1, the gates 20 are positioned and activated in each direction that incoming traffic may appear. In the illustrated figure, only two tracks, each with a gate 20, comprising two slave sensors 30 and a master sensor 32, are shown. However, the master sensor 32 has the capability to accommodate as many slave sensors 30 as required to cover the tracks around the work area. The gate sensor units 20 are positioned approximately one mile in each direction from the perimeter of the work site 18. Although the transmission range of the equipment can be boosted, enabling the equipment to transmit over a longer distance, the longer transmission is not always necessary. Since not all trains move at 100 mph, a warning greater than one mile from the work site would cause work delays while the workers wait for a slow moving train to pass. The one mile distance provides a standard distance that serves to protect the workers from the rapidly moving trains while preventing unnecessary down time. Alternatively, multiple sensors and antennas can be placed at more than one location on a single track. This embodiment is described hereinafter in conjunction with FIG. 10. Since the slave sensors 30 can determine the speed of the approaching train, the time lapse between contact with the sensor and the work area can be calculated. This prevents the work crews from waiting for a slower moving train to arrive while still providing immediate notification of a rapidly moving train. This calculation can be done either by the master sensor 32 or the annunciator 40. As the work crew cannot be assured ahead of time from which direction a train will approach the work site, for safety purposes it is preferable that a pair of gates 20 be used per track.

A third unit, the annunciator 40, is placed at the work site 18 and positioned to be visible by, and within hearing range of, the work crew members. The annunciator 40 receives wireless information, indicated by arrows A, simultaneously from all gate units 20. The annunciator 40 processes the data to activate the warning system, in this embodiment consisting of bright flashing lights 44 and horns 42 mounted on the annunciator 40.

Figure 3:
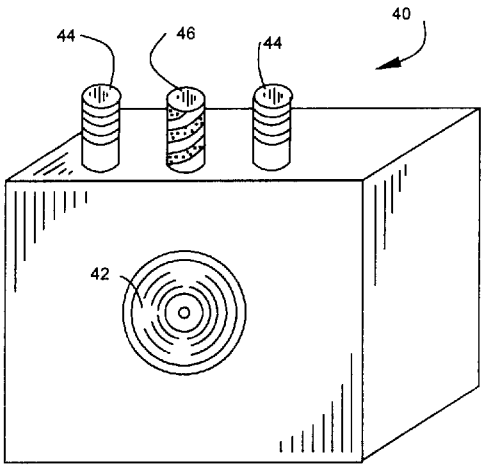
FIG. 3 is a perspective view of an alarm unit of the present invention.

As seen in FIG. 3, a rotating "barber pole" 46 serves as an indicator that the automatic self-testing and fail-safe system are operating and that the total system is functional. Although a barber pole 46 is illustrated herein, any "status quo" notification can be used. A strobe light, flashing green light, or even music can be used to indicate that all systems are operational. Once the status quo indicator stops, for any reason, a signal is sent to the horn 42 to activate distinct audible horn blasts. The audio warning for a system failure can be distinct from the audio warning of a train approaching, however this is not critical. The system can also be manufactured with the option of different audio alarms, with the alarm selected by the user being chosen based upon topography, background noise, etc. This audible alarm warns all personnel that the system is dysfunctional and should not to be relied upon until the technical problem is remedied. It should be noted that the barber pole 46 and the lights 44 are separate entities. While the lights 44 indicate the absence of traffic, the barber pole 46 indicates the status of the system. As long as the barber pole 46 rotates, indicating a functional system, the traffic alarms built into the system are in working order. If, however, the barber pole 46 is not rotating when the alarms are activated, the system is not reliable and immediate attention must be drawn to locating the system breach.

Figure 2:
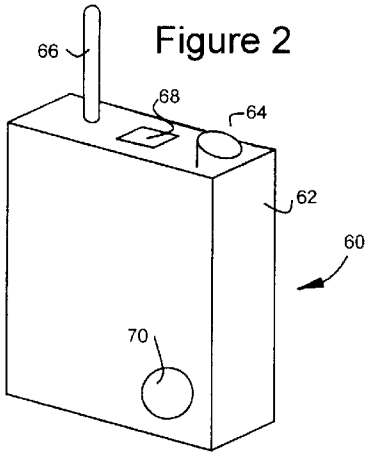
FIG. 2 is a perspective view of the personal unit of the disclosed invention.

In addition to the above warning devices, personal transceivers 60, illustrated in FIG. 2, are provided to each of the work crew. Although the disclosure refers to personal transceivers, receivers or transmitters can be used, however the transceiver provides an additional safety feature by permitting the annunciator to poll the personal devices. A second transceiver, or transmitter, inside the annunciator 40 transmits a trigger signal to the personal transceivers 60 that activates an audible alarm on the personal transceiver 60 in conjunction with the alarms at the annunciator 40. Alternatively, a transceiver within the annunciator can sequentially poll each of the personal transceivers, indicating everything is "OK" at the annunciator and asking for the status of the personal transceiver. When the transceiver indicates all is "OK" the annunciator transceiver continues polling. This system provides dual advantages in that the annunciator is able to verify that the personal transceiver is working and/or that the person wearing the transceiver has not initiated any of the alarms within the personal transceiver. The personal transceiver, in turn is able to determine that the annunciator transceiver is working. A break in the signal can activate the selected alarms tied to the polling frequency.

Figure 4:
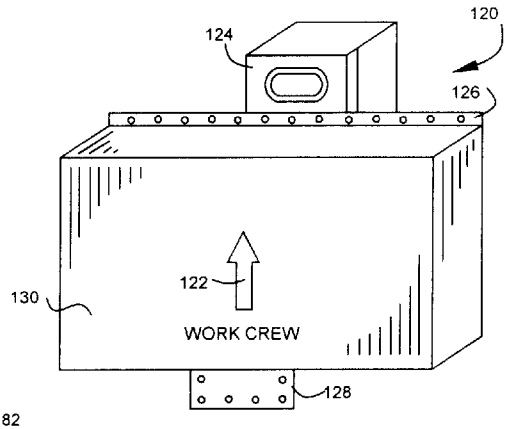
FIG. 4 is a perspective view of a sensor in accordance with the present invention.

One embodiment of the slave sensor 120, illustrated in more detail in FIG. 4, is a rugged and weatherproof module that is nailed, or otherwise secured, to a cross tie between the rails of the track. In the illustrated embodiment, securing plates 126 and 128 are used to maintain the slave sensor 120 in position, although other methods can be used as will be obvious to those skilled in the art. An indicating arrow 122 on the module is oriented to point to the work crew and establishes the entry or exit direction of the gate 120 being established. The direction of the train is sensed by the gate sensor 120, therefore enabling the sensor 120 to send a train approaching signal to the annunciator 40 that includes the direction of the approach. Although an option, it is preferable that the sensor 120 is provided with a handle 124 to allow for ease of handling.

The sensor 120 uses a Doppler microwave sensor to detect the presence and direction of the train and is only one type of sensing mechanism that can be incorporated in the disclosed system. Additional energy field generating sensors are disclosed hereinafter. Mechanical sensor used in conjunction with the disclosure system must be protected from the elements to prevent malfunction. The Doppler, as well as other systems disclosed herein, enable the slave sensor 120 to be sensitive to speed, as well as direction, thereby requiring the train to be moving at a preset minimum to activate the train approaching alarms. Generally, trains moving six (6) miles per hour or less provide little threat as they have a sufficiently low speed to enable workers to move to a safe distance based on an audio or visual warning.

The sensor 120 signal continues as long as the signal is bounced back to the sensor 120 from the train. If the system is programmed to activate the outbound alarm when the train is leaving the work area, the outbound gate 32 will send the signal until the last car has cleared the sensor 120. Although under normal working circumstances, once the train has passed the work area the workers could resume work, there can be instances where this programming is required.

The gate 36 consists of one master sensor 32 and multiple slave sensors 20. The slave sensors 20 send data, through a hardwire system, directly to the master sensor 32 that transmits the data to the annunciator 40. Although in the preferred embodiment, the master sensor 32 is a separate unit from the slave sensor 20, the two units can be combined. This combined unit would receive data from the other slave units and transmit this data directly to the annunciator. The combined unit is also more economical for single-track situations.

The battery on all sensor embodiments can be recharged from a module hookup located in the annunciator 40 or any other power source typically used for battery recharging. As a safety feature, the annunciator 40 preferably sets off an alarm to indicate that the batteries on the master sensor 32 are low. Depending upon system programming, the slave sensors can receive power from the master sensor or contain their own power sources. In the event the slave sensors contain individual power sources, the logic board can be programmed to send a signal to the master sensor for "forwarding" to the annunciator. In addition, a sensor "OK" light can be provided to indicate that the batteries have been charged, the antenna is securely plugged in, etc. Since each of the slave sensors and master sensors has an ID number, the specific sensor causing the alarm can be indicated on the annunciator 40.

The master sensors 32 are in constant communication with the annunciator 40, sending a signal every two seconds. Preferably a transmit LED flashes each time a signal is sent to the annunciator 40 to enable visual verification of a working system during installation of the gates 30. If the LED does not flash, it serves as an indication that the sensor 32 is unable to send to the annunciator 40. Similarly, there must be some indication, on either the slave sensor 20 or the master sensor 32, to indicate that a signal is being transmitted between the slave and master sensors. Thus the master sensor 32 is constantly sending a signal to the annunciator 40 notifying that the slave sensors 20 have indicated the presence, or lack of presence of a train. The annunciator 40 immediately sets off an alarm if, for any reason the signal completely ceases from one of the master sensors 32. Additionally the alarm system is activated if the signal received from the master sensor 32 does not indicate a response from all slave sensors 20. As will be seen in the example schematic disclosed hereinafter, the slave sensor identifier must be received by the master sensor 32 to avoid a system down alert. This system must be designed so that if it fails, it fails on the side of safety.

Within the master sensor 32 is a display panel consisting of an LCD display, LED's, and a row of input devices, such as buttons or switches. The LED's provide information as to the status of the sensor 20 including, but not limited to:

1) Power—System power status
2) Transmit—flashes each time the sensor transmits to the annunciator.
3) Reset—on power up and upon pressing the RESET button, this LED will blink, verifying the microprocessor has been initialized. All data is stored in a nonvolatile memory enabling all defaults to be loaded upon Reset.
4) Receive—flashes each time the slave sensor sends data to the master sensor.

The interior push buttons have the following functions:

1) Reset—Resets the system processor and reinitializes the system back to the factory-programmed defaults.
2) # Slave Sensors—This coordinates which slave sensor is placed on which track to enable the master sensor to know how many slave sensors are sending data and their location. The number of installed slave sensors is transmitted to the master sensor and, if the number of sensors responding at each poll is not the same as the number of installed slave sensors, the next poll signal to the annunciator indicates a missing sensor signal and the alarm system is triggered.
3) Test—Pressing this button will cycle the sensor through an internal test of such items as the battery, vibration sensor, or other preprogrammed status check. The LCD will show the test results sequentially.

The foregoing is by way of example and does not limit the scope of the information potentially provided by the system. Since all sensors contain a microprocessor chips, any data that is determined pertinent to the particular end use can be programmed in at time of manufacture.

The annunciator unit 40 is the warning unit for the system and is provided with both audible alarms 42 and visual outputs 44 to alert the work crew when any traffic enters a gate 36 at greater than the preprogrammed speed. The annunciator unit 40 contains monitoring functions to monitor not only internal systems but also the gates 36 and the personal transceivers 60 described further herein. These monitoring functions are also tied into the alarm system to indicate failure in any portion of the system.

Due to the severity of the failure to warn workers, the disclosed system uses both alarms activated by signal and those activated by a loss of signal to provide warning of either system failure or approaching train. These individual warning indicators operate on an "all clear" and a "danger" basis. As stated heretofore, the annunciator 40 contains, in addition to the lights 44 and the horn 42, an indicator device that continually states that all systems are functioning properly. If all of the programmed criteria are not satisfied, i.e., any self test function should fail on any unit, sensor to antenna connection is severed, signal not received from any antenna, the rotating barber pole 46, or indicator device, will automatically switch off and the horn 46 will activate. It is important that the horn 46, or other audible device, be activated upon failure of any module within the system to avoid any chance of the failure being missed. Although the illustrated device incorporates a barber pole 46 that rotates when all systems are in order, other indicators, such as a colored light, can be used. Preferably, there is some physical indicator, such as the barber pole 46, which informs the workers that the system is working and the tracks are clear. In an alternate embodiment, the rotating barber pole can be replaced with a rotating colored light and siren that are activated during a system failure. Thus, the system failure indicators can be both audibly and visually different from the train approaching warning. As stated heretofore, if the system fails, it should fail on the side of safety. In other words, it is preferable to have something stop upon failure rather than something start upon failure. In the preferred embodiment one indicator (rotating pole) stops upon failure while another (horn) initiates upon failure.

This warning system must also include a fail-safe warning of the possibility of battery depletion in the annunciator unit 40 itself, as well as in the master sensors 32. The battery power is monitored and a low battery activates the horn alarm. A separate, fully charged back up battery is also maintained in the annunciator system 40 and serves to continue activation of the horn 46 in the event the alarm is ignored to the point draining the initial battery.

Figure 10:
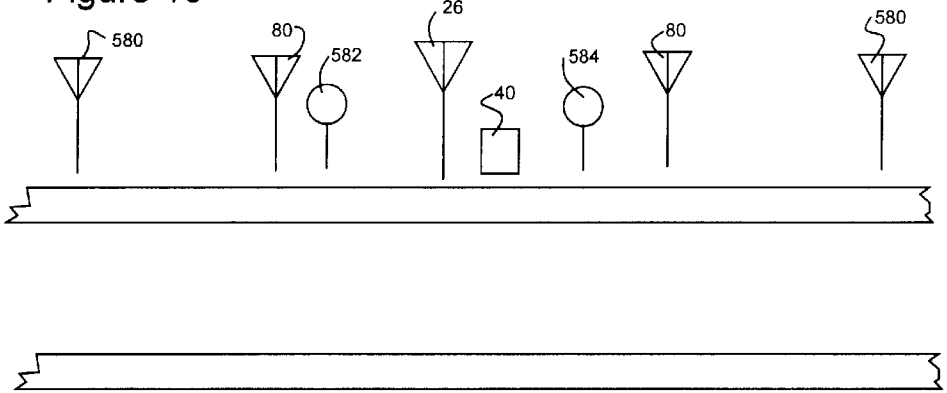
FIG. 10 is an alternate layout of the disclosed system using multiple antenna and sensors.

As the data received from the slave sensors 20, through the master sensor 32, provides the annunciator system 40 with the direction of the approaching train, lights can be provided to indicate to the workers the direction of approach. To avoid confusion with other warning systems, it preferable that the lights, which can be color coded if desired, are spaced from the annunciator 40, as seen in FIG. 10. In this alternate arrangement, the lights 582 and 584 are separated from the annunciator 40 and elevated on poles to provide better visibility. The lights 582 and 584 are preferably hard wired to the annunciator 40, although other methods known in the art can be used. In case of multiple tracks, either multiple pairs of lights can be placed proximate each track or LEDs can be used with the number of the track incorporated within the light.

The annunciator 40 constantly, and with fail-safe reliability, simultaneously monitors the messages from all master sensors 32, emphatically notifying the work crew of train movement and direction through all of the gates 36. The annunciator unit 40 must be portable, by means of carrying handles (not shown) and self-powered, by means of rechargeable batteries, to allow for easy transportation to each work site. It is preferable that the annunciator unit 40 is set in an area at the work site where it is in view and hearing range to all members of the crew. The location preferably provides visibility not only while directly in the work area but also while they are standing aside to let the incoming or outgoing traffic clear. Thus, in the event additional traffic arrives, the crew will not inadvertently re-enter the work zone 18.

Setup of the annunciator 40 requires powering on the unit. Preferably the annunciator 40 automatically runs a self-test and detects the number of slave sensors 20, thereby setting the number of tracks being monitored. Although the system will work without the automatic detection by the annunciator 40, it is a preferred safety feature in that it assures the procedure has been done. As a further safety check, the number of slave sensors 20 can manually entered at the annunciator 40 at part of the initial set up. Thus, the system knows how many slave sensors 20 are to be accounted for at a particular installation.

The annunciator also contains an LCD display, LEDs, and a row of buttons, switches, or other input device, for user interface. The interface is preferably duplicated for each master sensor. Therefore, if two master sensors are used, the annunciator contains two independent receivers, or transceivers.

The LEDs show the following:

1) Track Activity—whenever the train is inbound, this LED will be lit.
2) CB Detect—This LED is off when the track sensor is transmitting. The annunciator should detect transmission from the gate sensor at least every two seconds.
3) RESET—This LED is off when the system is being initialized.
4) Fail-safe—If any of the fail-safe conditions have been activated the LED is on.

The input functions include:

1) Reset—This will reinitialize the system.
2) Quiet—This will turn off the horn in the event work needs to be done on the annunciator or the horn needs to be silenced for any other reason. Preferably, this is on a timed basis to ensure that the horn is reactivated in the event it is not manually reactivated.
3) Sensor—This should be used to set the number of slave sensors sending data to the gate sensor.
4) Test—This activates the internal system test. The display will show the test results sequentially for any criteria preset into the system.

The foregoing indications for both LED and the input functions are for example only and other functions can also be input/adjusted and/or monitored.

The personal transceivers 60 are worn by each individual and are designed to give an audible alarm whenever train traffic or fail-safe conditions exist. The illustrated personal transceiver 60 is about 4 in.×6 in.×2 in., however this is an example, and size will be dictated by the internal components of the unit. The personal receivers 60 give another indication of either fail safe activity or an approaching train. The personal receivers 60 are activated simultaneously with the annunciator unit 40's activation of the horn 42. Depending upon cost considerations, the personal receivers 60 can be provided with visual and/or vibratory functions as well as audio. Optionally, the personal receivers are provided with output ports which allow for additional warning devices, such as an ear plug microphone, skin patch vibratory device, or other such warning device known in the art. In this way, workers who are working in high noise areas will have an alternate warning device.

To activate the receiver, the switch 64 is activated and the LED 68 lit. If the LED 68 does not turn on, the internal alarm activates indicating that the receiver 60 should not be used. Optionally, failure of a personal transceiver 60 will activate the main system failure alarm at the annunciator 40. The specific failed personal transceiver 60 can be pinpointed by providing each of the receivers with an ID number that is programmed into with the annunciator 40. In this way, the ID of the failed personal transceiver 60 is indicated at the annunciator 40. Generally, activation of the alarm is an indication that the batteries should be recharged; however other problems may have occurred and the receiver should be checked before use. To test the personal transceiver 60, the test switch on the annunciator 40 from the interior panel should be depressed to activate the annunciator 40 alarms light 44 and horn 42) as well as the personal unit alarm 70.

Upon receiving an alarm signal from the annunciator 40, the personal transceiver 60 will activate for a predetermined time. Several alarm timings can be incorporated into the personal receivers; e.g., intermittent activation until the alarm is switched off, activation for a predetermined time with an automatic reset or continual activation until reset. The type of alarm system can be determined by the manufacturer or, if desired, a choice of alarm systems can be provided on the unit to be chosen by the user depending upon preference and work situation.

Figure 5:
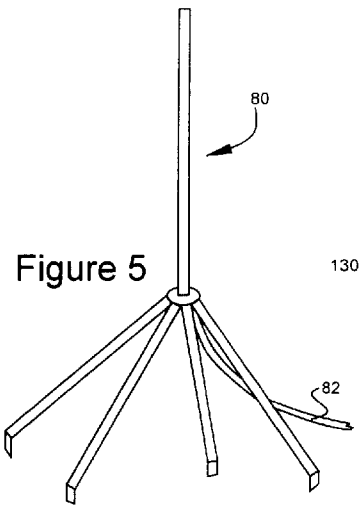
FIG. 5 is a perspective view of an antenna for used with the disclosed system.

In FIG. 5 a typical antenna 80 arrangement for use with the disclosed alarm system is illustrated. The antenna 80 must have a wide, sturdy base for stability and a transmission range of at least one mile. The antenna 80 must have the ability to communicate with the master sensor 32 and is generally hardwired to the sensor 32 through use of a cable 82. There are, however, multiple types of antennas, including microwave, which can be incorporated with the disclosed system and will be evident to those skilled in the art.

To setup and activate the system, the slave sensors 20 are placed on, and secured to, the tracks with a direction indicator placed toward the work crew area 18. The method of securing the sensor 20 to the track is dependent upon the embodiment and will be evident to those skilled in the art. If only one slave sensor 20 is used per track, it is critical that the crew verifies that the inbound direction of the selected tracks is correct. Placing the slave sensor on the outbound side of the track will not warn personnel at the work site of the train approaching and could result in serious injury or death. When a pair of slave sensors 20 are used per track, on either side of the work area, the concern associated with the inbound direction of each track is eliminated.

Once the slave sensor 20 is secured, the antenna assembly 80 is placed securely at a safe location and the antenna cable 82 connected to the master sensor 32. The antenna assembly 80 must be in a straight line with the annunciator antenna in order to transmit the signal. In case of mountainous terrain, multiple antennas 80 must be used to accomplish the straight-line transmission and their placement will be apparent to those skilled in the art. Alternatively, the signals can be bounced off a satellite, eliminating the need for the antennas, or placing the antennas as a back up signal source. The master sensor 32 and slave sensors 20 activated by methods applicable to the embodiments installed. Once activated, the test switch should be depressed to verify that no errors exist.

Once the slave sensors 20 and master sensor 32 are secured, the annunciator unit 40 is placed in a visible section of the work zone 18. An antenna 80, generally attached through use of the antenna cable 82, is placed at a safe place and in a position to receive signals from the master sensor 32. To ensure proper reception, the antenna 80 should be placed within an appropriate distance from the annunciator unit 40, depending upon the type of antenna used. Once the annunciator unit 40 is activated, the barber pole 46, or other indicator device, should activate within a predetermined time, generally about five seconds. If not, the system is not functional and should not be relied upon for train traffic warning.

Once the barber pole 46 is rotating, the personal receivers 60 are activated. The activation of the personal receivers 60 is verified by pressing the test switch on the annunciator unit 40. The test switch should activate the lights 44 and horn 42 on the annunciator unit 40 and the horn 70 on the personal receivers 60. In addition, the LCD on the annunciator unit 40 will display the status of all system components.

The annunciator unit 40, personal transceivers 60, slave sensors 20 and the master sensors 32 are preferably in constant communication with one another. This constant communication allows the annunciator unit 40 to acknowledge that each of the sensors 32 and personal transceivers 60 are working properly. If, for any reason, this constant check signal ceases, the annunciator unit 40 activates the audio alarm 42.

Batteries in the disclosed system are located in the master sensor 32, annunciator 40, and personal transceivers 60. As noted heretofore, the slave 30 can contain individual batteries and these batteries should meet standards set for the other units. All batteries are calculated to give at least 10 hours of service and the frequent battery levels are checked as part of the fail-safe check. If the annunciator 40 or master sensor 32 battery is discharged to a level that will compromise the system performance, the fail-safe system will activate, notifying all personnel. The battery within the personal transceiver 60 is monitored by a LED or other visual indicator. If the LED is not lit, the internal alarm will sound, indicating that the battery requires recharging. In general, anytime an alarm is activated, the work site personnel should visually check the barber pole rotation to verify that the system is up and working. If the barber pole, or other indicator, has stopped, the system is not operational.

The annunciator 40 contains two self-contained battery chargers that are activated by plugging in the 110 VAC cord and placing an "on/off" switch to charge. The annunciator 40 preferably also serves to charge the master sensor 32 battery. A charger plug within annunciator 40 housing is designed to connect to the master sensor 32 battery and recharging time is typically less than six (6) hours. To verify the charge status, the LEDs on the charging boards should be check with green indicating that the batteries are ready. If the red LED is still on after six hours, the battery is defective. The personal transceivers 60 are recharged through use of a wall transformer supplied with the unit. These are only examples of battery recharging system that can be incorporated and other system can be used.

The disclosed system is designed to provide reliable, fail-safe service. The fail-safe features of this design require that there is consistent communication between the slave sensors 30 and master sensor 32 and the master sensor 32 and the annunciator 40. The slave sensors 30 should communicate with the master sensor 32 about every two (2) seconds to prevent an error message from being sent to the annunciator 40. The data message from the master sensor 32 must be received and tested for accuracy every two seconds or the annunciator 40 will enter the fail-safe mode. In addition, the master sensor 32 and annunciator 40 batteries must be above a minimum voltage to operate correctly. If not, the fail-safe will occur. The communication between the slave and master sensors is generally through a hardwire and the signal can be simply sending by the slave or polling between the units. Further other means of communication between the units, such as RF, can be incorporated. The communication between the master sensor and the annunciator is preferably done through polling using RF waves, however other methods, evident to those skilled in the art, can be incorporated.

The illustrated fail-safe alarm consists of activating the lights 44 and horn 42 and deactivating the barber pole 46 rotation device, although as stated above, other alarm devices can be substituted. Anytime there is an alarm, it is necessary to visually check the annunciator 40 to verify if train traffic is imminent or the fail-safe has occurred. The incoming train warning and the fail-safe alarm can be different, or the same alarms, depending on manufacturer preferences.

Figure 11:
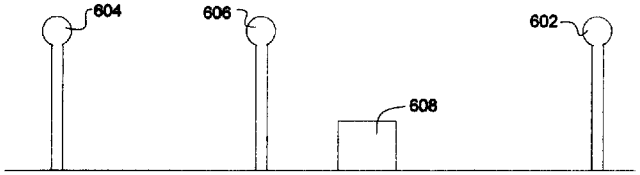
FIG. 11 is a plan view of an alternate layout of the disclosed system using multiple indicator lights.

In the example embodiment illustrated in FIG. 11, the incoming traffic lights 602 and 604 can be separated from the annunciator 608 and placed toward the periphery of the work area. If desired, only the incoming traffic light in the direction of the incoming traffic can flash. Alternatively, both lights can flash, providing no indication of the direction of approach. The fail safe indicator 606 in this embodiment is separated from the incoming traffic lights 602 and 604 and located proximate the annunciator 608. It should be noted that in this and all other embodiments, any of the indicators and/or lights can be colored, rotate, etc. and modifications will be obvious to those skilled in the art.

The gate 36 consists of one master sensor 32 and multiple slave sensors 30. The slave sensors 20 send data, through a hardwire system, directly to the master sensor 32 that transmits the data to the annunciator 40. Although in the preferred embodiment, the master sensor 32 is a separate unit from the slave sensor 30, the two units can be combined. This combined unit would receive data from the other slave units and transmit this data directly to the annunciator. The combined unit is also more economical for single track situations.

The battery on all sensor embodiments can be recharged from a module hookup located in the annunciator 40 or any other power source typically used for battery recharging. As a safety feature, the annunciator 40 preferably sets off an alarm to indicate that the batteries on the master sensor 32 are low. In addition, a sensor "OK" light can be provided to indicate that the batteries have been charged, the antenna is securely plugged in, etc. Since each of the slave sensors and master sensors has an ID number, the specific sensor causing the alarm can be indicated on the annunciator 40.

Figure 6:
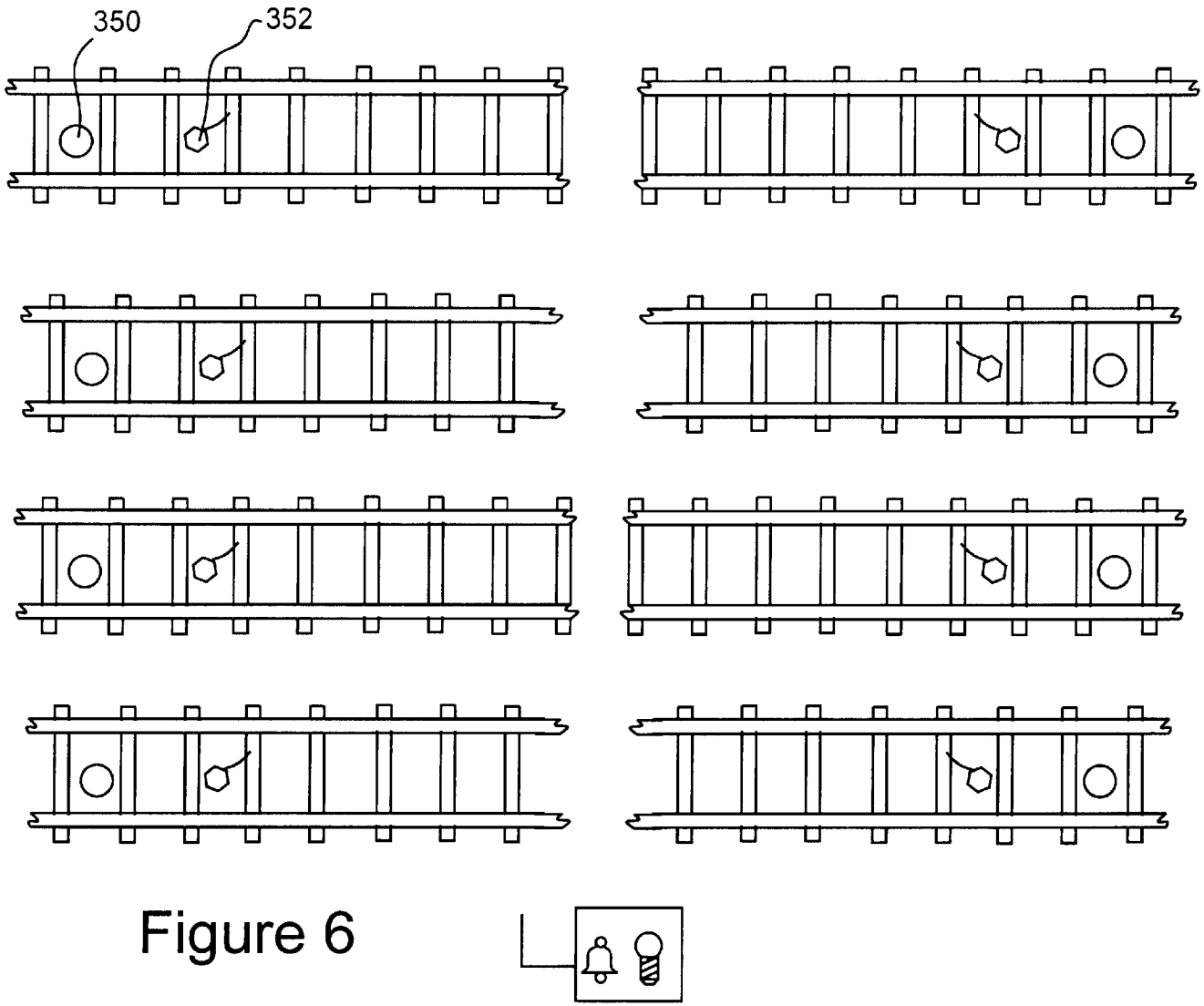
FIG. 6 is a schematic illustration of a four track railroad showing sensors in place.
Figures 7, 8:
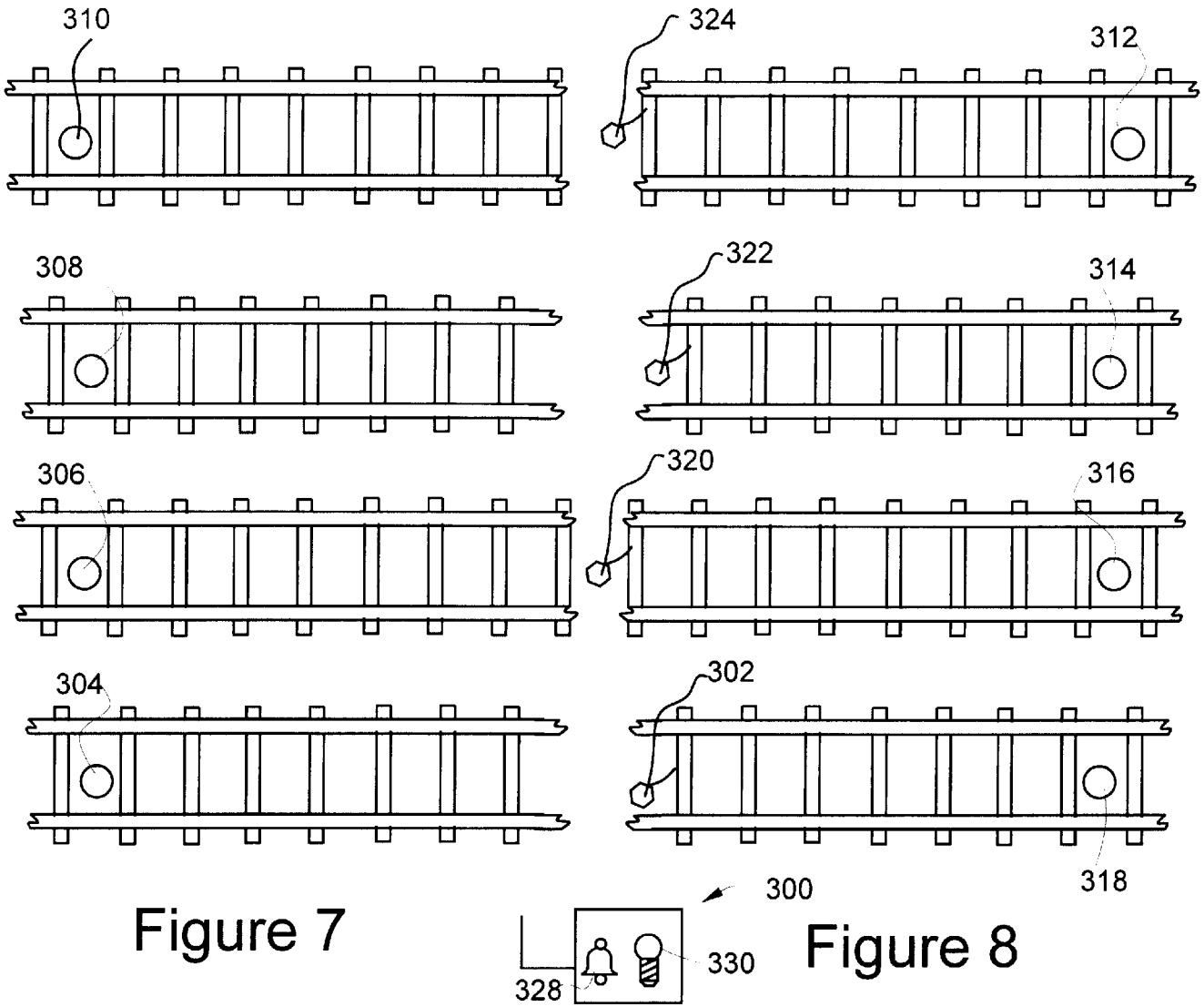
FIG. 7 is a schematic illustration of a four track railroad showing an alternate positioning of sensors.
FIG. 8 is a schematic illustration of a four track railroad showing a further alternate positioning of sensors.

To ensure the accuracy of the system, a seismic sensor is preferably included within the slave sensor. In FIGS. 6–8, various configurations are illustrated wherein the slave sensor and seismic sensor are separate. In the preferred embodiment, the system logic requires both the seismic and presence sensors to activate the alarm. It should be noted that presence sensors include mechanical, Doppler or other RF, and proximity sensors, as well as other sensors that would be applicable in light of the disclosure. If a seismic signal is received by the slave sensor for two seconds or longer, without a signal from the presence sensor, the slave sensor signal transmits the absence of a signal to the master sensor 32 where it is transmitted the annunciator 40 to activate the error alarm.

In FIG. 6 the slave sensor 350 and the seismic sensor 352 are proximate one another, separated in this example by one cross tie space. In FIG. 7, several placements are illustrated wherein the slave sensors 310, 308, 306 and 304, contain both the seismic and the presence sensor. The gate sensors 312, 314, 316, and 318 contain only the disclosed presence sensor and are hardwired to the seismic sensors 324, 322, 320, and 302. These figures illustrate example of the various possible sensor placements and other placement and combinations will become evident to those skilled in the art. Whether the slave sensor contain both the presence and seismic sensors; the master sensor is placed on or adjacent the tracks; or another arrangement is installed, it is critical that the annunciator 300 and alarms 328 and 330 be in constant communication with the sensors.

Figure 9:
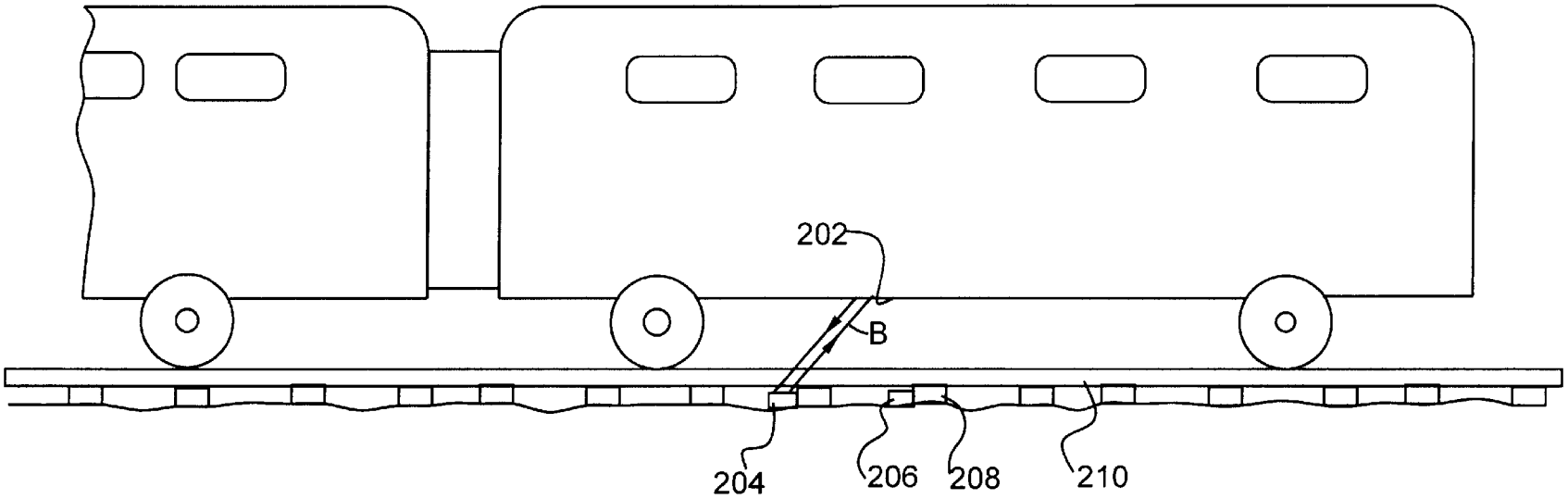
FIG. 9 is an elevational view of a train passing over a Doppler radar sensor unit.

In FIG. 9, a train 202 is illustrated passing over the Doppler slave sensor 204 and a seismic sensor 206. The seismic sensor 206 has been attached to the cross ties 208 between the tracks 210. As can seen by arrows B the sensor 204 sends and receives the signal from the train 202.

In FIG. 10 additional antennas 580 have been set up adjacent the tracks at a distance further from the annunciator 40 than the antennas 80. The use of the antennas 580, and their respective sensors, is advantageous in areas where the train may be changing speed. Since the system is programmed to initiate a warning only if the train is approaching at a speed of greater than, for example 6 mph, an increase or decrease of speed at the one mile point may affect the alarm. The additional antennas 580 can transfer information, such as to train speed, to the antenna 80, and subsequently the annunciator 40, to provide more comprehensive data regarding the approaching train.

Since the system is being used as for warning of the approach of a train, the percentage of failure of any element must be as low as possible. Since the system must be capable of being used outside in all weather, the elements of the system must withstand extreme hot and cold temperatures. To enable the sensor to work during snow, dust, etc., etc., a proximity sensor is used that is activated by the disruption of charge.

Figure 12:
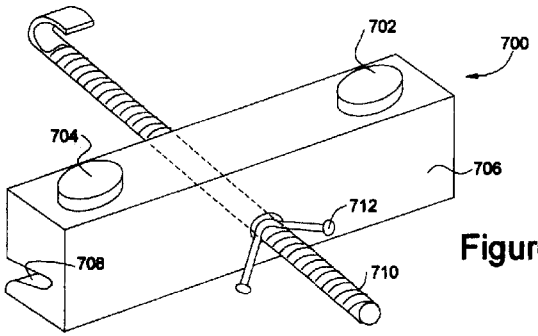
FIG. 12 is a perspective view of a proximity sensor for use with the disclosed system.
Figure 13:
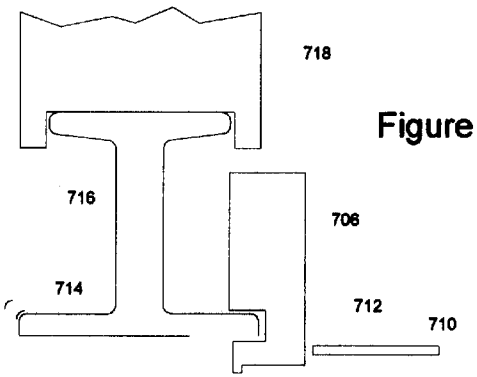
FIG. 13 is an cut end view of a train wheel interacting with the proximity sensor of FIG. 12.

The proximity sensor 700, of FIG. 12, has an inbound sensor 702 and an outbound sensor 704, a portion of each extending above the sensor case 706. The sensor case 706 is preferably manufactured with a track receiving notch 708 to enable a portion of the sensor 700 to be placed under the lower leg 714 of the track, as illustrated in FIG. 13. A U-shaped retaining bolt 710 secures the sensor 700 in position adjacent the track 716. The retaining bolt 710 is placed under the track 716 with the U portion of the bolt 710 engaging the lower leg 714. The bolt 710 passes through the sensor case 706 and, through use of the wing nut 712, maintains the lower leg 174 within the receiving notch 708.

Figure 14:
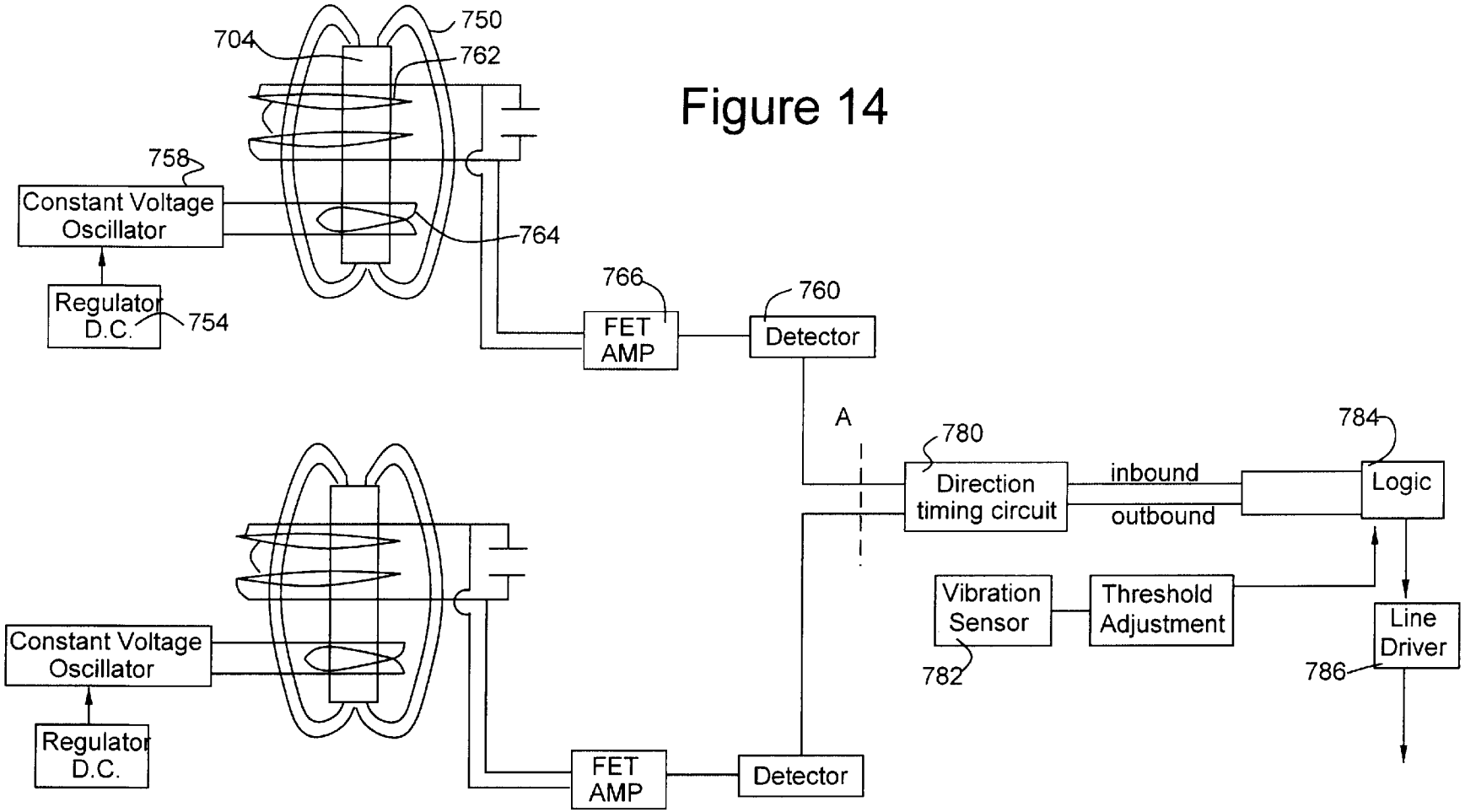
FIG. 14 is a schematic of a slave sensor using the proximity sensor.
Figure 15:
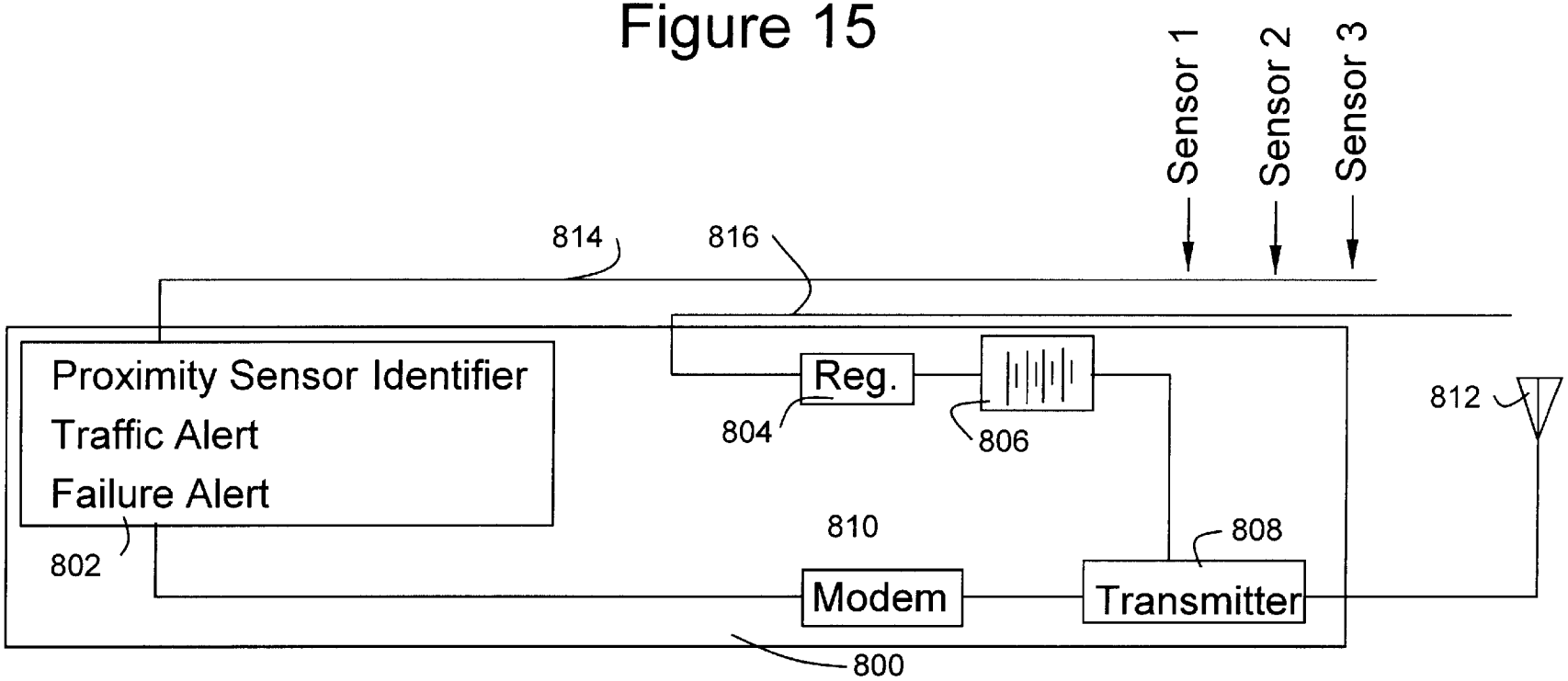
FIG. 15 is a schematic of a master sensor.

The sensor 700 uses a ferrite core, or equivalent, that gives off multiple lines of alternating flux 750, as illustrated in the example schematic of FIG. 14. Power is fed into the core 704 from the D.C. Regulator 754, through the constant voltage oscillator 758. When the charge (Q) is high, the constant voltage oscillator 758 drives the primary coil 764, efficiently coupling the oscillator 758 energy into the resonate secondary coil 762. As long as Q remains high, the energy in the secondary coil 762 retains a large percentage of energy from the previous cycle. A small amount of additional energy is derived through the loose coupling from the primary coil. The high impedance amplifier, field effect transistor 766 provides the detector 760 with a constant output. When the train wheel passes over the coil 704, intercepting the alternating flux lines, the cycle to cycle energy storage is degraded, immediately reducing the secondary voltage. The reduced voltage is detected by the detector 760 and a signal is sent to the direction timing circuit 780.

Whether the train is inbound or outbound is determined by which of the two coils is initially disrupted. The first signal sent to the timing circuit 780 provides the information regarding the direction of the train. The time between the disruption from each wheel is calculated to provide the speed of travel. This data, along with the data from the vibration sensor 782 is sent to the logic board 784. The logic board 784 sends three types of signals to the line driver 786. If the board 784 receives an inbound signal and a vibration alert, the signal sent to the line driver 786 is to place the annunciator on alert status. If the board 784 receives an outbound signal and a vibration alert, a "status quo" signal is sent. When only one signal, vibration without a direction or direction without vibration, is received, a system failure alert is sent to the annunciator. It should be noted that although the sensor core 702 is referred to as the inbound core, either core can serve to notify as inbound or outbound and specific references herein are for ease of explanation only.

Each of the proximity sensors 700 contains its individual unit identifier, generally within the logic board 784. When a signal is sent, whether it is an alert, status quo or system failure, the data is accompanied by the unit identifier. The identifier for each sensor is sent to the master sensor 800 and ultimately to the annunciator, along with the status data. Although this is information predominantly used as a verification for which sensors are working, this data can provide advantages in other areas, such as tracking the direction and amount of traffic on specific tracks. If multiple sensors are used along a track to chart the progress of the train, the identifier assists in pinpointing the location of the train.

Each proximity sensor 700 is preferably provided with a line driver 786 to prepare the impedance and voltage for transmission to the master sensor 800. By using individual drivers 786, the signals from all sensors are maintained discrete within the transmission line 814 as shown in FIG. l5. The power to the proximity sensors 700 is provided by the power line 816 that leads from the battery 806 to each sensor 700.

The master sensor 800 receives the data from the various proximity sensors 700 through the transmission line 814 to the processor 802. The processor 802 recognizes the proximity sensor identifier and ties that identifier with the status data. As stated, the status data includes notification of inbound or outbound traffic and system failure, as well as the status quo signal of "no traffic." The processor 802 takes this information to the modem 810 and transmitter 808 where it is sent, through use of the antenna 812, to the annunciator.

It should be noted that although the foregoing system is described using the proximity sensor, the basic system can be used with other types of sensors. A mechanical sensor that is activated by contact with the wheel can be substituted for the proximity sensor 700. Further, the Doppler system, as described heretofore, uses the same basic sensing system. Dividing line A is used in FIG. 13 to indicate the point within the example schematic that the actual sensing device can be varied. From the direction timing circuit 780 to the master sensor, the circuitry would remain the same with the actual method of sensing the train varying.

EXAMPLE I

| Specifications | |
|---|---|
| Master Sensor: | |
| Size: | 14 × 14 × 8 inches including handle |
| Weight: | 28 pounds (including batteries) |
| Construction: | Weatherproof all fiberglass with carry handle |
| Battery: | Removable gel cell, rechargeable, 10 hr. endurance |
| Data Link: | Wireless digital, continuous updating |
| Data Range: | 1 mile typical |
| Annunciator: | |
| Size: | 12 × 24 × 12 |
| Weight: | 45 pounds (including batteries) |
| Construction: | Weatherproof all fiberglass with carry handle |
| Battery: | Rechargeable, also recharges track sensor batteries |
| Outputs: | Strobe lights and electronic horn |
| Fail-safe: | Continuous self test |
| Fail-safe Indication: | Rotating indicator and independent horn |
| Personal Receiver: | |
| Size: | 4 × 6 × 2 |
| Weight: | 4.5 pounds (including batteries) |
| Construction: | Weatherproof all metal enclosure |
| Battery: | Rechargeable nickel cadmium, 10+ hour endurance |
| Battery charger: | Self contained |
| Outputs: | Electronic sounder |
| Fail-safe: | Continuous self test |
| Fail-safe Indication: | Sounder alarm |

Since other modifications and changes varied to fit particular operating requirements and environments will be apparent to those skilled in the art, the invention is not considered limited to the example chosen for the purposes of disclosure, and covers all changes and modifications which do not constitute departures from the true spirit and scope of this invention.

What is claimed is:

1. A transportable warning system for notification of the approach of a track guided train to a temporary work area perimeter, said system having:

at least one gate, each of said at least one gate having:

a master sensor, said master sensor being contained within a protective casing having securing means, said securing means removably affixing said master sensor to a stationary object proximate a track for guiding a train, and being in a position such to enable said master sensor to register predetermined data, said predetermined data including at least track activity, speed, direction of activity or no track activity, said master sensor transmitting signals, in predetermined repetition, said signals containing said predetermined data;

a collection member, said collection member receiving the sensor signals containing said predetermined data for transmission;

data transmitting means, said data transmitting means transmitting said signals, in predetermined repetition, from said collection member to a remote receiving member;

a first antenna, said first antenna transmitting said signals;

an annunciator, said annunciator having:

at least a second antenna to receive transmission from said first antenna, a remote receiving member to receive the collection member signals, a data analysis member, said data analysis member receiving and analyzing said collection member signals containing predetermined data and determining the status of said predetermined data, including that all predetermined data was received to indicate full warning system operation;

transmitting means, said transmitting means sending notification of track activity to a first indicator, notification of no track activity to a second indicator and full warning system operation to a third indicator;

wherein continued activation of said second indicator indicates that said perimeter is safe and activation of said first indicator indicates track activity and that said perimeter is unsafe and a change in said third indicator indicates that the system is not fully operational.

2. The system of claim 1 wherein said master sensor further comprises an analysis member, said analysis member analyzing data received by said collection member, comparing said data with preprogrammed data criteria and transmitting said analyzed data to said remote receiving member.

3. The system of claim 1 wherein said master sensor is a vibration sensor.

4. The system of claim 2 further comprising at least one slave sensor, said slave sensor having a protective casing having securing means, said securing means removably affixing said slave sensor to a stationary object in a position such to enable said slave sensor to transmit signals, in predetermined repetition, to said data collection member within said master sensor.

5. The system of claim 4 wherein the full system operation transmission must include all predetermined data from each of said at least one slave sensor and said master sensor and omission of at least one of said signals activates said third indicator.

6. The system of claim 1 wherein said master sensor is a proximity sensor.

7. The system of claim 1 wherein said master sensor is Doppler radar.

8. The system of claim 1 wherein said signals are RF signals, antenna relaying said RF signals between said first antenna to said second antenna.

9. The system of claim 1 wherein at least one indicator member is spaced from said annunciator proximate said work area perimeter.

10. The system of claim 9 wherein said at least one indicator member is raised substantially from ground level.

11. The system of claim 2 wherein said analysis member of said predetermined data includes the speed of the train, below a preprogrammed speed said system remains in a safe mode and above a preprogrammed speed said system is activated.

12. The system of claim 1 further comprising at lease one individual remote unit, each of said at least one remote unit having remote transmission means, said remote transmission means sending data to said annunciator and receiving data from said annunciator, in predetermined repetition, said sending data being status of said remote unit and said receiving data being status of said system.

13. The system of claim 12 wherein said remote unit further comprises at least one alarm member, said alarm member being activated by said receiving data.

14. A transportable warning system for notification of the approach of a track guided train to a temporary work area perimeter, said system having:

at least one gate, each of said at least one gate having:

a master sensor, said master sensor being contained within a protective casing having securing means, said securing means removably affixing said master sensor to a stationary object proximate a track for guiding a train, and being in a position such to enable said master sensor to register predetermined data, said predetermined data including at least track activity, speed, direction of activity and no track activity, said master sensor continually transmitting signals, in predetermined repetition, said signals containing said predetermined data;

a collection member, said collection member receiving the sensor signals containing said predetermined data for transmission;

data transmitting means, said data transmitting means transmitting said signals, in predetermined repetition, from said collection member to a remote receiving member;

a first antenna, said first antenna transmitting said signals; an annunciator, said annunciator being within said work area perimeter and having:

at least a second antenna to receive transmission from said first antenna, a remote receiving member to receive the collection member signals, a data analysis member, said data analysis member receiving and analyzing said collection member signals containing predetermined data and determining the status of said predetermined data, including that all predetermined data was received to indicate full warning system operation;

transmitting means, said transmitting means sending notification of track activity to a first indicator, notification of no track activity to a second indicator and full warning system operation to a third indicator;

wherein continued activation of said second indicator indicates that said perimeter is safe and activation of said first indicator indicates track activity and that said perimeter is unsafe and a change in said third indicator indicates that the system is not fully operational;

wherein said master sensor further comprises an analysis member, said analysis member analyzing data received by said collection member, comparing said data with preprogrammed data criteria and transmitting said analyzed data to said remote receiving member; and wherein said system further comprises direction indicators, a first direction indicator being activated by the approach of a train in a first direction and a second direction indicator being activated by the approach of a train in a second direction.

15. A transportable warning system for notification of the approach of a track guided train to a temporary work area perimeter, said system having:

at least one gate, each of said at least one gate having:

a master sensor, said master sensor being contained within a protective casing having securing means, said securing means removably affixing said master sensor to a stationary object proximate a track for guiding a train, and being in a position such to enable said master sensor to register predetermined data, said predetermined data including at least track activity, speed, direction of activity and no track activity, said master sensor continually transmitting signals, in predetermined repetition, said signals containing said predetermined data;

a collection member, said collection member receiving the sensor signals containing said predetermined data for transmission;

data transmitting means, said data transmitting means transmitting said signals, in predetermined repetition, from said collection member to a remote receiving member;

a first antenna, said first antenna transmitting said signals;

an annunciator, said annunciator being within said work area perimeter and having:

at least a second antenna to receive transmission from said first antenna, a remote receiving member to receive the collection member signals, a data analysis member, said data analysis member receiving and analyzing said collection member signals containing predetermined data and determining the status of said predetermined data, including that all predetermined data was received to indicate full warning system operation;

transmitting means, said transmitting means sending notification of track activity to a first indicator, notification of no track activity to a second indicator and full warning system operation to a third indicator;

wherein continued activation of said second indicator indicates that said perimeter is safe and activation of said first indicator indicates track activity and that said perimeter is unsafe and a change in said third indicator indicates that the system is not fully operational;

wherein said master sensor further comprises an analysis member, said analysis member analyzing data received by said collection member, comparing said data with preprogrammed data criteria and transmitting said analyzed data to said remote receiving member;

wherein, said system further comprises at least one slave sensor, said slave sensor having a protective casing having securing means, said securing means removably affixing said slave sensor to a stationary object in a position such to enable said slave sensor to transmit signals, in predetermined repetition, to said data collection member within said master sensor; and wherein said protective casing is marked with a direction indicator, said direction indicator enabling all sensors to be positioned in a uniform direction.

16. A transportable warning system for notification of the approach of a track guided train to a work area perimeter, said system having:

at least one gate, each of said at least one gate having:

at least one slave sensor member, each of said at least one slave sensor member being contained within a protective casing, said casing being marked with a direction indicator to enable all sensors to be positioned in a uniform direction, said at least one slave sensor member registering at least track activity or no track activity and repeatedly transmitting signals indicating the approach direction and speed of travel of said train, to a data collection member within said master sensor;

a master sensor, said master sensor being with a sensor casing including securing means, said securing means removably affixing said master sensor to a stationary object in a position to enable said master sensor to gather said predetermined data, said master sensor having:

a data collection member to receive signals from each of said at least one slave sensor member, a data analysis member, said data analysis member receiving said sensor signals from said data collection member for analysis, said analysis including predetermined data;

sensor transmitting means, said sensor transmitting means repeatedly, within a predetermined time, transmitting the sensor and data analysis member signals to a remote receiving member;

an annunciator, said annunciator having:

a remote receiving member to receive said sensor and said data analysis member signals, a sensor data analysis member, said sensor data analysis member receiving and analyzing said sensor and data analysis member signals containing predetermined data, said predetermined data including signals received from both said data collection member and each of said at least one master sensor, and determining the status of said data, said data including notification of track activity or no track activity and that all predetermined was received to indicate full system operation;

transmitting means, said transmitting means sending notification of track activity to a first indicator, notification of no track activity to a second indicator and full system operation to a third indicator each of said indicators being raised substantially from ground level;

at least two antenna, a first of said at least two antenna being proximate said annunciator and at least a second of said at least two antenna being proximate said work area perimeter and each of said at least one gate;

wherein continued activation of said second indicator indicates that said perimeter is safe and activation of said first indicator indicates track activity and that said perimeter is unsafe and a change in said third indicator indicates that the system is not fully operational.

17. The system of claim 16 wherein said at least one slave sensor is a pair of sensors, each of said sensors being placed equidistant from said work area perimeter on a same track.

18. The method of warning workers in a work area of the approach of a train in sufficient time to enable the workers to move a safe distance from the train, using a warning system having at least one gate, each of said at least one gate having:

at least one slave sensor member, each of said at least one slave sensor member being contained within a protective casing, said casing being marked with a direction indicator to enable all sensors to be positioned in a uniform direction, said at least one slave sensor member registering at least track activity or no track activity and repeatedly transmitting signals indicating the approach direction and speed of travel of said train, to a data collection member a master sensor, said master sensor being with a sensor casing including securing means, said securing means removably affixing said master sensor to a stationary object in a position to enable said master sensor to gather said predetermined data, said master sensor having:

a data collection member to receive signals from each of said at least one slave sensor member, a data analysis member, said data analysis member receiving the sensor signals from said data collection member for analysis, said analysis including predetermined data;

sensor transmitting means, said sensor transmitting means repeatedly, within a predetermined time, transmitting said sensor and data analysis member signals to a remote receiving member;

an annunciator, said annunciator having:

a remote receiving member to receive the sensor and the data analysis member signals, a sensor data analysis member, said sensor data analysis member receiving and analyzing said sensor and data analysis member signals containing predetermined data, said predetermined data including signals received from both said data collection member and each of said at least one master sensor, and determining the status of said data, said data including notification of track activity or no track activity and that all predetermined was received to indicate full system operation;

transmitting means, said transmitting means sending notification of track activity to a first indicator, notification of no track activity to a second indicator and full system operation to a third indicator each of said indicators being raised substantially from ground level;

at least two antenna, a first of said at least two antenna being proximate said annunciator and at least a second of said at least two antenna being proximate said work area perimeter and each of said at least one gate comprising the steps of:

a. establishing a first work area perimeter;

b. placing a master sensor at a distance from said perimeter to provide sufficient warning time to said workers;

c. placing slave sensors, proximate said master sensor, on each of the tracks that intersect said perimeter, d. connecting said slave sensors to said master sensor;

e. erecting an antenna proximate said master sensor;

f. repeating steps b. through e. for each master sensor;

g. placing said annunciator within said work area perimeter;

h. erecting an antenna proximate said annunciator positioned to receive signals from said antenna proximate said master sensor;

i. ensuring visibility of said indicators;

j. activating said system;

k. completing work within said work area perimeter;

l. deactivating said system;

m. disconnecting said slave sensors to said master sensor;

n. removing said antenna proximate said master sensor;

o. repeating steps m. through n. for each master sensor;

p. removing said annunciator within said work area perimeter, q. removing said an antenna proximate said annunciator;

r. establishing a second work area perimeter;

s. repeating steps b–p;

wherein continued activation of said second indicator indicates that said perimeter is safe and activation of said first indicator indicates track activity and that said perimeter is unsafe and a change in said third indicator indicates that the system is not fully operational.

* * * * *